US010582290B2

(12) United States Patent
Hviid et al.

(10) Patent No.: US 10,582,290 B2
(45) Date of Patent: Mar. 3, 2020

(54) EARPIECE WITH TAP FUNCTIONALITY

(71) Applicant: BRAGI GmbH, München (DE)

(72) Inventors: Nikolaj Hviid, München (DE); Michael Hlatky, München (DE)

(73) Assignee: BRAGI GmbH, München (DE)

( * ) Notice: Subject to any disclaimer, the term of this patent is extended or adjusted under 35 U.S.C. 154(b) by 0 days.

(21) Appl. No.: 15/894,288

(22) Filed: Feb. 12, 2018

(65) Prior Publication Data

US 2018/0242069 A1 Aug. 23, 2018

Related U.S. Application Data

(60) Provisional application No. 62/461,657, filed on Feb. 21, 2017.

(51) Int. Cl.
*H04R 1/10* (2006.01)
*H04R 1/04* (2006.01)

(52) U.S. Cl.
CPC ..... *H04R 1/105* (2013.01); *H04R 1/04* (2013.01); *H04R 1/1041* (2013.01); *H04R 2201/10* (2013.01)

(58) Field of Classification Search
CPC ..... H04R 1/1058; H04R 1/1075; H04R 2201/105; H04R 2201/107
See application file for complete search history.

(56) References Cited

U.S. PATENT DOCUMENTS 2,325,590 A 8/1943 Carlisle et al.
2,430,229 A 11/1947 Kelsey
3,047,089 A 7/1962 Zwislocki
D208,784 S 10/1967 Sanzone
3,586,794 A 6/1971 Michaelis
3,934,100 A 1/1976 Harada
3,983,336 A 9/1976 Malek et al.
4,069,400 A 1/1978 Johanson et al.
(Continued)

FOREIGN PATENT DOCUMENTS

CN 204244472 U 4/2015
CN 104683519 A 6/2015
(Continued)

OTHER PUBLICATIONS

Akkermans, "Acoustic Ear Recognition for Person Identification", Automatic Identification Advanced Technologies, 2005 pp. 219-223.

(Continued)

*Primary Examiner* — Fan S Tsang
*Assistant Examiner* — Angelica M McKinney
(74) *Attorney, Agent, or Firm* — Goodhue, Coleman & Owens, P.C.

(57) ABSTRACT

An earpiece comprises an earpiece housing, a digital signal processor disposed within the ear piece housing, and at least one microphone operatively connected to the digital signal processor. The earpiece is configured to receive audio from the at least one microphone and process the audio with the digital signal processor to determine if a user has performed a tap on the earpiece. The earpiece may further include a wireless transceiver disposed within the ear piece wherein the earpiece is configured to communicate data indicative of occurrence of the tap using the wireless transceiver.

15 Claims, 3 Drawing Sheets

(56) References Cited

U.S. PATENT DOCUMENTS 4,150,262 A 4/1979 Ono
4,334,315 A 6/1982 Ono et al.
D266,271 S 9/1982 Johanson et al.
4,375,016 A 2/1983 Harada
4,588,867 A 5/1986 Konomi
4,617,429 A 10/1986 Bellafiore
4,654,883 A 3/1987 Iwata
4,682,180 A 7/1987 Gans
4,791,673 A 12/1988 Schreiber
4,852,177 A 7/1989 Ambrose
4,865,044 A 9/1989 Wallace et al.
4,984,277 A 1/1991 Bisgaard et al.
5,008,943 A 4/1991 Arndt et al.
5,185,802 A 2/1993 Stanton
5,191,602 A 3/1993 Regen et al.
5,201,007 A 4/1993 Ward et al.
5,201,008 A 4/1993 Arndt et al.
D340,286 S 10/1993 Seo
5,280,524 A 1/1994 Norris
5,295,193 A 3/1994 Ono
5,298,692 A 3/1994 Ikeda et al.
5,343,532 A 8/1994 Shugart
5,347,584 A 9/1994 Narisawa
5,363,444 A 11/1994 Norris
D367,113 S 2/1996 Weeks
5,497,339 A 3/1996 Bernard
5,606,621 A 2/1997 Reiter et al.
5,613,222 A 3/1997 Guenther
5,654,530 A 8/1997 Sauer et al.
5,692,059 A 11/1997 Kruger
5,721,783 A 2/1998 Anderson
5,748,743 A 5/1998 Weeks
5,749,072 A 5/1998 Mazurkiewicz et al.
5,771,438 A 6/1998 Palermo et al.
D397,796 S 9/1998 Yabe et al.
5,802,167 A 9/1998 Hong
D410,008 S 5/1999 Almqvist
5,929,774 A 7/1999 Charlton
5,933,506 A 8/1999 Aoki et al.
5,949,896 A 9/1999 Nageno et al.
5,987,146 A 11/1999 Pluvinage et al.
6,021,207 A 2/2000 Puthuff et al.
6,054,989 A 4/2000 Robertson et al.
6,081,724 A 6/2000 Wilson
6,084,526 A 7/2000 Blotky et al.
6,094,492 A 7/2000 Boesen
6,111,569 A 8/2000 Brusky et al.
6,112,103 A 8/2000 Puthuff
6,157,727 A 12/2000 Rueda
6,167,039 A 12/2000 Karlsson et al.
6,181,801 B1 1/2001 Puthuff et al.
6,208,372 B1 3/2001 Barraclough
6,230,029 B1 5/2001 Yegiazaryan et al.
6,275,789 B1 8/2001 Moser et al.
6,339,754 B1 1/2002 Flanagan et al.
D455,835 S 4/2002 Anderson et al.
6,366,677 B1 * 4/2002 Sigwanz ..... G06F 9/4812 381/312
6,408,081 B1 6/2002 Boesen
6,424,820 B1 7/2002 Burdick et al.
D464,039 S 10/2002 Boesen
6,470,893 B1 10/2002 Boesen
D468,299 S 1/2003 Boesen
D468,300 S 1/2003 Boesen
6,542,721 B2 4/2003 Boesen
6,560,468 B1 5/2003 Boesen
6,563,301 B2 5/2003 Gventer
6,654,721 B2 11/2003 Handelman
6,664,713 B2 12/2003 Boesen
6,690,807 B1 2/2004 Meyer
6,694,180 B1 2/2004 Boesen
6,718,043 B1 4/2004 Boesen
6,738,485 B1 5/2004 Boesen
6,748,095 B1 6/2004 Goss
6,754,358 B1 6/2004 Boesen et al.
6,784,873 B1 8/2004 Boesen et al.
6,823,195 B1 11/2004 Boesen
6,852,084 B1 2/2005 Boesen
6,879,698 B2 4/2005 Boesen
6,892,082 B2 5/2005 Boesen
6,920,229 B2 7/2005 Boesen
6,952,483 B2 10/2005 Boesen et al.
6,987,986 B2 1/2006 Boesen
7,010,137 B1 3/2006 Leedom et al.
7,113,611 B2 9/2006 Leedom et al.
D532,520 S 11/2006 Kampmeier et al.
7,136,282 B1 11/2006 Rebeske
7,203,331 B2 4/2007 Boesen
7,209,569 B2 4/2007 Boesen
7,215,790 B2 5/2007 Boesen et al.
D549,222 S 8/2007 Huang
D554,756 S 11/2007 Sjursen et al.
7,403,629 B1 7/2008 Aceti et al.
D579,006 S 10/2008 Kim et al.
7,463,902 B2 12/2008 Boesen
7,508,411 B2 3/2009 Boesen
D601,134 S 9/2009 Elabidi et al.
7,825,626 B2 11/2010 Kozisek
7,965,855 B1 6/2011 Ham
7,979,035 B2 7/2011 Griffin et al.
7,983,628 B2 7/2011 Boesen
D647,491 S 10/2011 Chen et al.
8,095,188 B2 1/2012 Shi
8,108,143 B1 1/2012 Tester
8,140,357 B1 3/2012 Boesen
D666,581 S 9/2012 Perez
8,300,864 B2 10/2012 Müllenborn et al.
8,406,448 B2 3/2013 Lin
8,430,817 B1 4/2013 Al-Ali et al.
8,436,780 B2 5/2013 Schantz et al.
D687,021 S 7/2013 Yuen
8,679,012 B1 3/2014 Kayyali
8,719,877 B2 5/2014 VonDoenhoff et al.
8,774,434 B2 7/2014 Zhao et al.
8,831,266 B1 9/2014 Huang
8,891,800 B1 11/2014 Shaffer
8,994,498 B2 3/2015 Agrafioti et al.
D728,107 S 4/2015 Martin et al.
9,013,145 B2 4/2015 Castillo et al.
9,037,125 B1 5/2015 Kadous
D733,103 S 6/2015 Jeong et al.
9,081,944 B2 7/2015 Camacho et al.
9,510,159 B1 11/2016 Cuddihy et al.
D773,439 S 12/2016 Walker
D775,158 S 12/2016 Dong et al.
D777,710 S 1/2017 Palmborg et al.
9,544,689 B2 1/2017 Fisher et al.
D788,079 S 5/2017 Son et al.
2001/0005197 A1 6/2001 Mishra et al.
2001/0027121 A1 10/2001 Boesen
2001/0043707 A1 11/2001 Leedom
2001/0056350 A1 12/2001 Calderone et al.
2002/0002413 A1 1/2002 Tokue
2002/0007510 A1 1/2002 Mann
2002/0010590 A1 1/2002 Lee
2002/0030637 A1 3/2002 Mann
2002/0046035 A1 4/2002 Kitahara et al.
2002/0057810 A1 5/2002 Boesen
2002/0076073 A1 6/2002 Taenzer et al.
2002/0118852 A1 8/2002 Boesen
2003/0002705 A1 1/2003 Boesen
2003/0065504 A1 4/2003 Kraemer et al.
2003/0100331 A1 5/2003 Dress et al.
2003/0104806 A1 6/2003 Ruef et al.
2003/0115068 A1 6/2003 Boesen
2003/0125096 A1 7/2003 Boesen
2003/0218064 A1 11/2003 Conner et al.
2004/0070564 A1 4/2004 Dawson et al.
2004/0160511 A1 8/2004 Boesen
2005/0017842 A1 1/2005 Dematteo
2005/0043056 A1 2/2005 Boesen
2005/0094839 A1 5/2005 Gwee
2005/0125320 A1 6/2005 Boesen
2005/0148883 A1 7/2005 Boesen

(56) References Cited

U.S. PATENT DOCUMENTS

2005/0165663 A1 7/2005 Razumov
2005/0196009 A1 9/2005 Boesen
2005/0251455 A1 11/2005 Boesen
2005/0266876 A1 12/2005 Boesen
2006/0029246 A1 2/2006 Boesen
2006/0073787 A1 4/2006 Lair et al.
2006/0074671 A1 4/2006 Farmaner et al.
2006/0074808 A1 4/2006 Boesen
2006/0166715 A1 7/2006 Engelen et al.
2006/0166716 A1 7/2006 Seshadri et al.
2006/0220915 A1 10/2006 Bauer
2006/0258412 A1 11/2006 Liu
2008/0076972 A1 3/2008 Dorogusker et al.
2008/0090622 A1 4/2008 Kim et al.
2008/0146890 A1 6/2008 LeBoeuf et al.
2008/0187163 A1 8/2008 Goldstein et al.
2008/0253583 A1 10/2008 Goldstein et al.
2008/0254780 A1 10/2008 Kuhl et al.
2008/0255430 A1 10/2008 Alexandersson et al.
2008/0298606 A1* 12/2008 Johnson ..... H04R 1/1091 381/74
2009/0003620 A1 1/2009 McKillop et al.
2009/0008275 A1 1/2009 Ferrari et al.
2009/0017881 A1 1/2009 Madrigal
2009/0073070 A1 3/2009 Rofougaran
2009/0097689 A1 4/2009 Prest et al.
2009/0105548 A1 4/2009 Bart
2009/0154739 A1 6/2009 Zellner
2009/0191920 A1 7/2009 Regen et al.
2009/0245559 A1 10/2009 Boltyenkov et al.
2009/0261114 A1 10/2009 McGuire et al.
2009/0296968 A1 12/2009 Wu et al.
2010/0033313 A1 2/2010 Keady et al.
2010/0203831 A1 8/2010 Muth
2010/0210212 A1 8/2010 Sato
2010/0320961 A1 12/2010 Castillo et al.
2011/0140844 A1 6/2011 McGuire et al.
2011/0239497 A1 10/2011 McGuire et al.
2011/0249824 A1* 10/2011 Asada ..... G06F 1/1626 381/56
2011/0286615 A1 11/2011 Olodort et al.
2011/0293102 A1* 12/2011 Kitazawa ..... H04R 1/1041 381/56
2012/0057740 A1 3/2012 Rosal
2012/0155670 A1 6/2012 Rutschman
2012/0309453 A1 12/2012 Maguire
2013/0106454 A1 5/2013 Liu et al.
2013/0316642 A1 11/2013 Newham
2013/0346168 A1 12/2013 Zhou et al.
2014/0004912 A1 1/2014 Rajakarunanayake
2014/0014697 A1 1/2014 Schmierer et al.
2014/0020089 A1 1/2014 Perini, II
2014/0072136 A1 3/2014 Tenenbaum et al.
2014/0079257 A1 3/2014 Ruwe et al.
2014/0106677 A1 4/2014 Altman
2014/0122116 A1 5/2014 Smythe
2014/0146973 A1 5/2014 Liu et al.
2014/0153768 A1 6/2014 Hagen et al.
2014/0163771 A1 6/2014 Demeniuk
2014/0185828 A1 7/2014 Helbling
2014/0219467 A1* 8/2014 Kurtz ..... H04R 3/12 381/74
2014/0222462 A1 8/2014 Shakil et al.
2014/0235169 A1 8/2014 Parkinson et al.
2014/0270227 A1 9/2014 Swanson
2014/0270271 A1 9/2014 Dehe et al.
2014/0335908 A1 11/2014 Krisch et al.
2014/0348367 A1 11/2014 Vavrus et al.
2015/0028996 A1 1/2015 Agrafioti et al.
2015/0035643 A1 2/2015 Kursun
2015/0036835 A1* 2/2015 Chen ..... H04R 1/1041 381/74
2015/0110587 A1 4/2015 Hori
2015/0148989 A1 5/2015 Cooper et al.
2015/0181356 A1 6/2015 Krystek et al.
2015/0245127 A1 8/2015 Shaffer
2015/0264472 A1 9/2015 Aase
2015/0264501 A1 9/2015 Hu et al.
2015/0358751 A1 12/2015 Deng et al.
2015/0359436 A1 12/2015 Shim et al.
2015/0373467 A1 12/2015 Gelter
2015/0373474 A1 12/2015 Kraft et al.
2016/0033280 A1 2/2016 Moore et al.
2016/0034249 A1* 2/2016 Lee ..... G06F 3/167 704/275
2016/0050509 A1* 2/2016 Madhu ..... H04R 1/1041 381/309
2016/0071526 A1 3/2016 Wingate et al.
2016/0072558 A1 3/2016 Hirsch et al.
2016/0073189 A1 3/2016 Lindén et al.
2016/0125892 A1 5/2016 Bowen et al.
2016/0162259 A1 6/2016 Zhao et al.
2016/0209691 A1 7/2016 Yang et al.
2016/0324478 A1 11/2016 Goldstein
2016/0353196 A1 12/2016 Baker et al.
2016/0360350 A1 12/2016 Watson et al.
2017/0059152 A1 3/2017 Hirsch et al.
2017/0060262 A1 3/2017 Hviid et al.
2017/0060269 A1 3/2017 Förstner et al.
2017/0061751 A1 3/2017 Loermann et al.
2017/0062913 A1 3/2017 Hirsch et al.
2017/0064426 A1 3/2017 Hviid
2017/0064428 A1 3/2017 Hirsch
2017/0064432 A1 3/2017 Hviid et al.
2017/0064437 A1 3/2017 Hviid et al.
2017/0078780 A1 3/2017 Qian et al.
2017/0078785 A1 3/2017 Qian et al.
2017/0108918 A1 4/2017 Boesen
2017/0109131 A1 4/2017 Boesen
2017/0110124 A1 4/2017 Boesen et al.
2017/0110899 A1 4/2017 Boesen
2017/0111723 A1 4/2017 Boesen
2017/0111725 A1 4/2017 Boesen et al.
2017/0111726 A1 4/2017 Martin et al.
2017/0111740 A1 4/2017 Hviid et al.
2017/0127168 A1 5/2017 Briggs et al.
2017/0131094 A1 5/2017 Kulik
2017/0142511 A1 5/2017 Dennis
2017/0146801 A1 5/2017 Stempora
2017/0151447 A1 6/2017 Boesen
2017/0151668 A1 6/2017 Boesen
2017/0151918 A1 6/2017 Boesen
2017/0151930 A1 6/2017 Boesen
2017/0151957 A1 6/2017 Boesen
2017/0151959 A1 6/2017 Boesen
2017/0153114 A1 6/2017 Boesen
2017/0153636 A1 6/2017 Boesen
2017/0154532 A1 6/2017 Boesen
2017/0155985 A1 6/2017 Boesen
2017/0155992 A1 6/2017 Perianu et al.
2017/0155993 A1 6/2017 Boesen
2017/0155997 A1 6/2017 Boesen
2017/0155998 A1 6/2017 Boesen
2017/0156000 A1 6/2017 Boesen
2017/0178631 A1 6/2017 Boesen
2017/0180842 A1 6/2017 Boesen
2017/0180843 A1 6/2017 Perianu et al.
2017/0180897 A1 6/2017 Perianu
2017/0188127 A1 6/2017 Perianu et al.
2017/0188132 A1 6/2017 Hirsch et al.
2017/0193978 A1 7/2017 Goldman
2017/0195829 A1 7/2017 Belverato et al.
2017/0208393 A1 7/2017 Boesen
2017/0214987 A1 7/2017 Boesen
2017/0215016 A1 7/2017 Dohmen et al.
2017/0230752 A1 8/2017 Dohmen et al.
2017/0251933 A1 9/2017 Braun et al.
2017/0257698 A1 9/2017 Boesen et al.
2017/0263236 A1 9/2017 Boesen et al.
2017/0273622 A1 9/2017 Boesen
2017/0280257 A1 9/2017 Gordon et al.
2017/0366233 A1 12/2017 Hviid et al.
2018/0007994 A1 1/2018 Boesen et al.

(56) References Cited

U.S. PATENT DOCUMENTS

| | | | | |
|---|---|---|---|---|
| 2018/0008194 | A1 | 1/2018 | Boesen | |
| 2018/0008198 | A1 | 1/2018 | Kingscott | |
| 2018/0009447 | A1 | 1/2018 | Boesen et al. | |
| 2018/0011006 | A1 | 1/2018 | Kingscott | |
| 2018/0011682 | A1 | 1/2018 | Milevski et al. | |
| 2018/0011994 | A1 | 1/2018 | Boesen | |
| 2018/0012228 | A1 | 1/2018 | Milevski et al. | |
| 2018/0013195 | A1 | 1/2018 | Hviid et al. | |
| 2018/0014102 | A1 | 1/2018 | Hirsch et al. | |
| 2018/0014103 | A1 | 1/2018 | Martin et al. | |
| 2018/0014104 | A1 | 1/2018 | Boesen et al. | |
| 2018/0014107 | A1 | 1/2018 | Razouane et al. | |
| 2018/0014108 | A1 | 1/2018 | Dragicevic et al. | |
| 2018/0014109 | A1 | 1/2018 | Boesen | |
| 2018/0014113 | A1 | 1/2018 | Boesen | |
| 2018/0014140 | A1 | 1/2018 | Milevski et al. | |
| 2018/0014436 | A1 | 1/2018 | Milevski | |
| 2018/0034951 | A1 | 2/2018 | Boesen | |
| 2018/0035217 | A1* | 2/2018 | Han | H04R 25/558 |
| 2018/0040093 | A1 | 2/2018 | Boesen | |

FOREIGN PATENT DOCUMENTS

| | | | |
|---|---|---|---|
| CN | 104837094 | A | 8/2015 |
| EP | 1469659 | A1 | 10/2004 |
| EP | 1017252 | A3 | 5/2006 |
| EP | 2903186 | A1 | 8/2015 |
| GB | 2074817 | | 4/1981 |
| GB | 2508226 | A | 5/2014 |
| JP | 06292195 | | 10/1998 |
| WO | 2008103925 | A1 | 8/2008 |
| WO | 2008113053 | A1 | 9/2008 |
| WO | 2007034371 | A3 | 11/2008 |
| WO | 2011001433 | A2 | 1/2011 |
| WO | 2012071127 | A1 | 5/2012 |
| WO | 2013134956 | A1 | 9/2013 |
| WO | 2014046602 | A1 | 3/2014 |
| WO | 2014043179 | A3 | 7/2014 |
| WO | 2015061633 | A2 | 4/2015 |
| WO | 2015110577 | A1 | 7/2015 |
| WO | 2015110587 | A1 | 7/2015 |
| WO | 2016032990 | A1 | 3/2016 |
| WO | 2016187869 | A1 | 12/2016 |

OTHER PUBLICATIONS

Alzahrani et al: "A Multi-Channel Opto-Electronic Sensor to Accurately Monitor Heart Rate against Motion Artefact during Exercise", Sensors, vol. 15, No. 10, Oct. 12, 2015, pp. 25681-25702, XP055334602, DOI: 10.3390/s151025681 the whole document.

Announcing the $3,333,333 Stretch Goal (Feb. 24, 2014).

Ben Coxworth: "Graphene-based ink could enable low-cost, foldable electronics", "Journal of Physical Chemistry Letters", Northwestern University, (May 22, 2013).

Blain: "World's first graphene speaker already superior to Sennheiser MX400", htt://www.gizmag.com/graphene-speaker-beats-sennheiser-mx400/31660, (Apr. 15, 2014).

BMW, "BMW introduces BMW Connected—The personalized digital assistant", "http://bmwblog.com/2016/01/05/bmw-introduces-bmw-connected-the-personalized-digital-assistant", (Jan. 5, 2016).

BRAGI Is On Facebook (2014).

BRAGI Update—Arrival Of Prototype Chassis Parts—More People—Awesomeness (May 13, 2014).

BRAGI Update—Chinese New Year, Design Verification, Charging Case, More People, Timeline(Mar. 6, 2015).

BRAGI Update—First Sleeves From Prototype Tool—Software Development Kit (Jun. 5, 2014).

BRAGI Update—Lets Get Ready To Rumble, A Lot To Be Done Over Christmas (Dec. 22, 2014).

BRAGI Update—Memories From April—Update On Progress (Sep. 16, 2014).

BRAGI Update—Memories from May—Update On Progress—Sweet (Oct. 13, 2014).

BRAGI Update—Memories From One Month Before Kickstarter—Update On Progress (Jul. 10, 2014).

BRAGI Update—Memories From The First Month of Kickstarter—Update on Progress (Aug. 1, 2014).

BRAGI Update—Memories From The Second Month of Kickstarter—Update On Progress (Aug. 22, 2014).

BRAGI Update—New People @BRAGI—Prototypes (Jun. 26, 2014).

BRAGI Update—Office Tour, Tour To China, Tour to CES (Dec. 11, 2014).

BRAGI Update—Status On Wireless, Bits and Pieces, Testing—Oh Yeah, Timeline(Apr. 24, 2015).

BRAGI Update—The App Preview, The Charger, The SDK, BRAGI Funding and Chinese New Year (Feb. 11, 2015).

BRAGI Update—What We Did Over Christmas, Las Vegas & CES (Jan. 19, 2014).

BRAGI Update—Years of Development, Moments of Utter Joy and Finishing What We Started(Jun. 5, 2015).

BRAGI Update—Alpha 5 and Back To China, Backer Day, On Track(May 16, 2015).

BRAGI Update—Beta2 Production and Factory Line(Aug. 20, 2015).

BRAGI Update—Certifications, Production, Ramping Up.

BRAGI Update—Developer Units Shipping and Status(Oct. 5, 2015).

BRAGI Update—Developer Units Started Shipping and Status (Oct. 19, 2015).

BRAGI Update—Developer Units, Investment, Story and Status(Nov. 2, 2015).

BRAGI Update—Getting Close(Aug. 6, 2015).

BRAGI Update—On Track, Design Verification, How It Works and What's Next(Jul. 15, 2015).

BRAGI Update—On Track, On Track and Gems Overview.

BRAGI Update—Status On Wireless, Supply, Timeline and Open House@BRAGI(Apr. 1, 2015).

BRAGI Update—Unpacking Video, Reviews On Audio Perform and Boy Are We Getting Close(Sep. 10, 2015).

Healthcare Risk Management Review, "Nuance updates computer-assisted physician documentation solution" (Oct. 20, 2016).

Hoffman, "How to Use Android Beam to Wirelessly Transfer Content Between Devices", (Feb. 22, 2013).

Hoyt et. al., "Lessons Learned from Implementation of Voice Recognition for Documentation in the Military Electronic Health Record System", The American Health Information Management Association (2017).

Hyundai Motor America, "Hyundai Motor Company Introduces A Health +Mobility Concept For Wellness In Mobility", Fountain Valley, Californa (2017).

International Search Report & Written Opinion, PCT/EP16/70245 (dated Nov. 16, 2016).

International Search Report & Written Opinion, PCT/EP2016/070231 (dated Nov. 18, 2016).

International Search Report & Written Opinion, PCT/EP2016/070247 (dated Nov. 18, 2016).

Jain A et al: "Score normalization in multimodal biometric systems", Pattern Recognition, Elsevier, GB, vol. 38, No. 12, Dec. 31, 2005, pp. 2270-2285, XPO27610849, ISSN: 0031-3203.

Last Push Before The Kickstarter Campaign Ends on Monday 4pm CET (Mar. 28, 2014).

Nemanja Paunovic et al, "A methodology for testing complex professional electronic systems", Serbian Journal of Electrical Engineering, vol. 9, No. 1, Feb. 1, 2012, pp. 71-80, XPO55317584, Yu.

Nigel Whitfield: "Fake tape detectors, 'from the stands' footle and UGH? Internet of Things in my set-top box"; http://www.theregister.co.uk/2014/09/24/ibc_round_up_object_audio_dlna_iot/ (Sep. 24, 2014).

Nuance, "ING Netherlands Launches Voice Biometrics Payment System in the Mobile Banking App Powered by Nuance", "https://www.nuance.com/about-us/newsroom/press-releases/ing-netherlands-launches-nuance-voice-biometirics.html", 4 pages (Jul. 28, 2015).

(56) References Cited

OTHER PUBLICATIONS

Staab, Wayne J., et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for The Dash (Feb. 12, 2014).
Stretchgoal—Windows Phone Support (Feb. 17, 2014).
The Dash +The Charging Case & The BRAGI News (Feb. 21, 2014).
The Dash—A Word From Our Software, Mechanical and Acoustics Team +An Update (Mar. 11, 2014).
Update From BRAGI—$3,000,000—Yipee (Mar. 22, 2014).
Wertzner et al., "Analysis of fundamental frequency, jitter, shimmer and vocal intensity in children with phonological disorders", V. 71, n.5, 582-588, Sep./Oct. 2005; Brazilian Journal of Othrhinolaryngology.
Wikipedia, "Gamebook", https://en.wikipedia.org/wiki/Gamebook, Sep. 3, 2017, 5 pages.
Wikipedia, "Kinect", "https://en.wikipedia.org/wiki/Kinect", 18 pages, (Sep. 9, 2017).
Wikipedia, "Wii Balance Board", "https://en.wikipedia.org/wiki/Wii_Balance_Board", 3 pages, (Jul. 20, 2017).

* cited by examiner

EARPIECE WITH TAP FUNCTIONALITY

PRIORITY STATEMENT

This application claims priority to U.S. Provisional Patent Application No. 62/461,657, filed Feb. 21, 2017, hereby incorporated by reference in its entirety.

FIELD OF THE INVENTION

The present invention relates to wearable devices. More particularly, but not exclusively, the present invention relates to earpieces.

BACKGROUND

Earpieces hold great promise as widely adopted wearable devices. One of the problems with earpieces continue to be limitations on the manner in which user input is provided. What is needed are improved earpieces which allow for receiving user input in an efficient and desirable manner.

SUMMARY

Therefore, it is a primary object, feature, or advantage of the present invention to improve over the state of the art.

It is a further object, feature, or advantage of the present invention to provide for new ways of receiving user input for ear pieces.

It is a still further object, feature, or advantage of the present invention to provide for new ways of receiving manual input from users.

Another object, feature, or advantage is to receive manual input from a user of an earpiece without needing a touch sensor.

Yet another object, feature, or advantage is to receive manual input from a user without needing manual buttons.

Another object, feature, or advantage of the present invention is to reduce or eliminate false positive indications that taps occurred.

Yet another object, feature, or advantage is to provide for a way for receiving manual input from a user which is easy for a user to use.

One or more of these and/or other objects, features, or advantages of the present invention will become apparent from the specification and claims that follow. No single embodiment need provide each and every object, feature, or advantage. Different embodiments may have different objects, features, or advantages. Therefore, the present invention is not to be limited to or by an objects, features, or advantages stated herein.

According to one aspect, an earpiece comprises an earpiece housing, a digital signal processor disposed within the ear piece housing, and at least one microphone operatively connected to the digital signal processor. The earpiece is configured to receive audio from the at least one microphone and process the audio with the digital signal processor to determine if a user has performed a tap on the earpiece. The earpiece may further include a wireless transceiver disposed within the ear piece wherein the earpiece is configured to communicate data indicative of occurrence of the tap using the wireless transceiver. The wireless transceiver may include a near field magnetic induction transceiver (NFMI) or a radio transceiver such as a Bluetooth, BLE, or other type of radio transceiver. Multiple transceivers may be present such as one NFMI transceiver and one BLE transceiver. The earpiece may further include a processor disposed within the ear piece housing and a wireless transceiver disposed within the ear piece housing and operatively connected to the processor and wherein the processor is configured to receive data indicative of the tap on the ear piece from the digital signal processor and wherein the processor is configured to receive data indicative of a tap on a different earpiece through the wireless transceiver. The processor may be further programmed to interpret one or more taps on the earpiece and/or one or more taps on the different earpiece as a user command and to perform an action based on the user command. The action may include communicating the user command to another device in operative communication with the earpiece. The earpiece may be configured to receive audio from the at least one microphone and process the audio with the digital signal processor to determine a location of the tap on the earpiece. The at least one microphone may be positioned to face outwards.

According to another aspect, an earpiece includes an earpiece housing, a processor disposed within the ear piece housing, at least one microphone operatively connected to the processor, and a wireless transceiver disposed within the earpiece housing and operatively connected to the processor. The earpiece is configured to receive audio from the at least one microphone and process the audio with the processor to determine if a user has performed a tap on the earpiece. The earpiece may be further configured to interpret user input comprising the tap and perform an action based on the user input. The user input may further include one or more taps on an additional earpiece in operative communication with the earpiece. The user input may include a plurality of taps including the tap. The wireless transceiver may be a radio transceiver.

According to another aspect, a system includes a set of earpieces including a left ear piece and a right ear piece, each of the earpieces comprising an ear piece housing, a digital signal processor disposed within the ear piece housing, at least one microphone operatively connected to the processor, wherein each of the earpieces is configured to receive audio from the at least one microphone and process the audio with the digital signal processor to determine if a user has performed a tap on the earpiece.

According to another aspect, a method for use in a wireless earpiece comprising an earpiece housing, a processor disposed within the earpiece housing, at least one microphone operatively connected to the processor. The method includes receiving user input comprising a physical tap by the user on the earpiece, monitoring audio associated with the user input from the at least one microphone, and processing the audio associated with the user input to determine occurrence of the physical tap. The method may further include performing an action based on the user input.

According to another aspect, an earpiece includes an earpiece housing, a digital signal processor disposed within the ear piece housing, and at least one intelligent microphone operatively connected to the digital signal processor. The earpiece is configured to receive audio from the at least one intelligent microphone and process the audio with the digital signal processor.

DETAILED DESCRIPTION

An earpiece wearable device may be used to sense acoustic events using one or more microphones of the earpiece, where the acoustic event is created by a mechanical or physical interaction with the device. For example, a user may tap the earpiece housing and the microphone(s) may sense the audio and a processor such as a digital signal processor may then analyze the audio to determine that the acoustic event was a tap. Thus, user input from a user may be sensed as an acoustic event. The user input may be a single tap on one earpiece, multiple taps on the earpiece, or where two earpieces are used (one left earpiece and one right earpiece), the user input may include one or more taps on each of the earpieces. The earpiece may interpret the user input as a command and perform one or more actions based on the command.

The microphone may be of any number of types. For example, the microphone may be a smart microphone or intelligent microphone from Knowles Corporation which integrates an audio processing algorithm with acoustic detection into a multi-mode digital microphones. One of the benefits of such a selection of microphone is that such a device can recognize when the audio should be in sleep mode and when it should be awakened thereby reducing power usage relative to a device which is always on in a battery usage mode.

It should be appreciated that user input in the form of taps may be used to perform any number of functions. These may include to raise or lower volume such as by receiving a tap on one earpiece to raise volume and receiving a tap on a second earpiece to lower volume. These may include receive a double tap to play music or pause music. Note that the use of taps or user input may be context-driven. Thus, while music is playing a double tap may pause the music. If the music is paused or stopped, the double tap may play the music. Similarly, a tap on one earpiece may be used to accept a phone call while a tap on the other earpiece may be used to reject the phone call.

Figure 1:
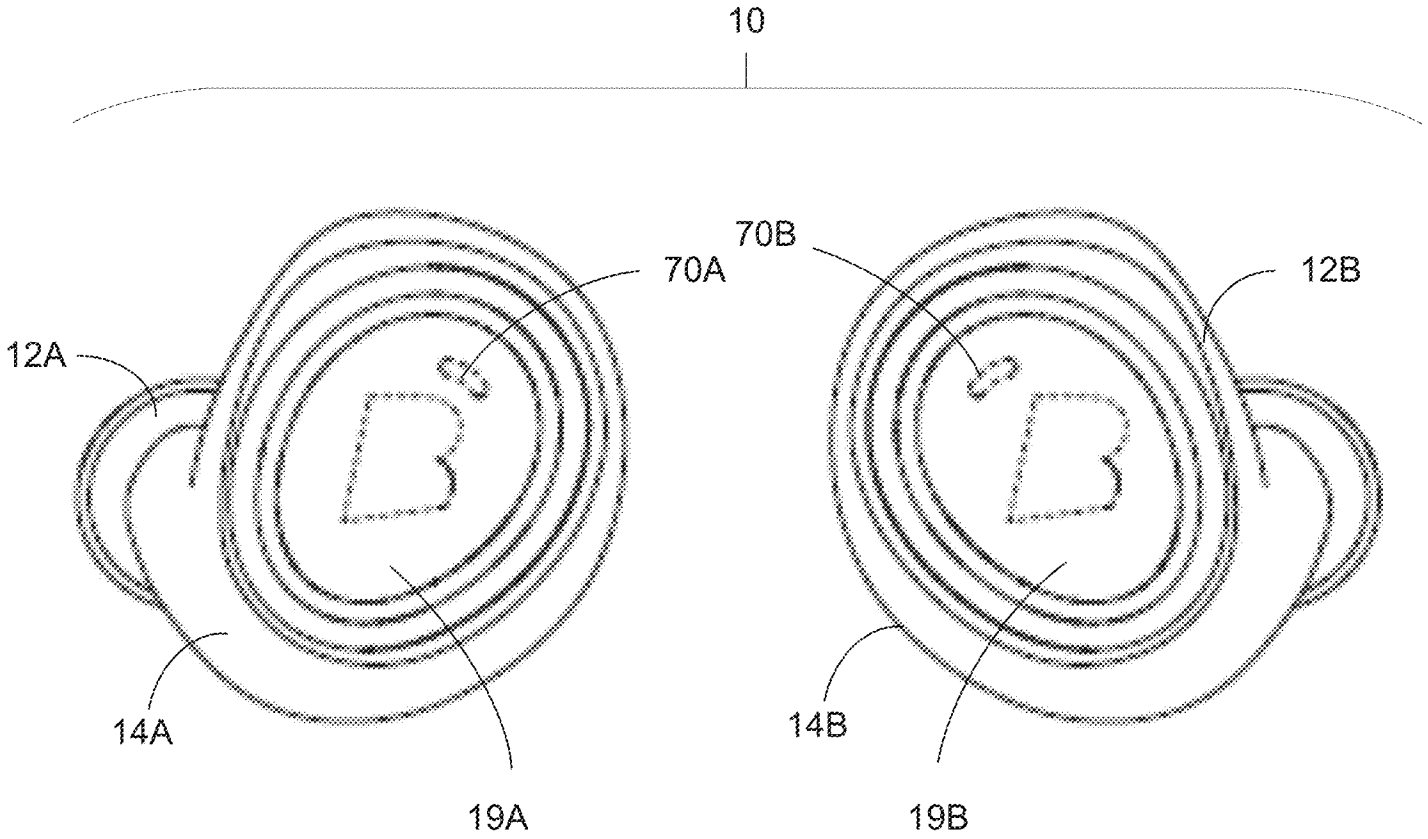
FIG. 1 illustrates one example of a system or set of earpieces including a left ear piece and a right ear piece with each ear piece having at least one microphone for detecting physical or mechanical user interactions such as taps.

FIG. 1 illustrates one example of a system or set of earpieces 10 which includes include a left earpiece 12A and a right earpiece 12B. Each of the earpieces includes an earpiece housing 14A, 14B. Each earpiece 12A, 12B may include one or more external surfaces on its housing 14A, 14B. Surfaces 19A, 19B are shown. The surfaces 19A, 19B may be used for tapping. Positioned at surfaces 19A, 19B are outward facing external microphones 70A, 70B. The microphones may be of the type previously described, MEMS microphones, or other types of microphones. The microphones may be used to detect acoustical events such as taps or other physical or mechanical interactions between a user and the microphones. In some embodiments, the physical or mechanical interactions may be a user tapping on their ears, temple, or head, or on another item such as glasses or jewelry. It should also be understood that instead of performing a tap directly on the earpiece it is contemplated that the tap may be performed near the earpiece such as at the ear or other location provided the acoustic event associated with the tap can be appropriately analyzed and characterized.

Figure 2:
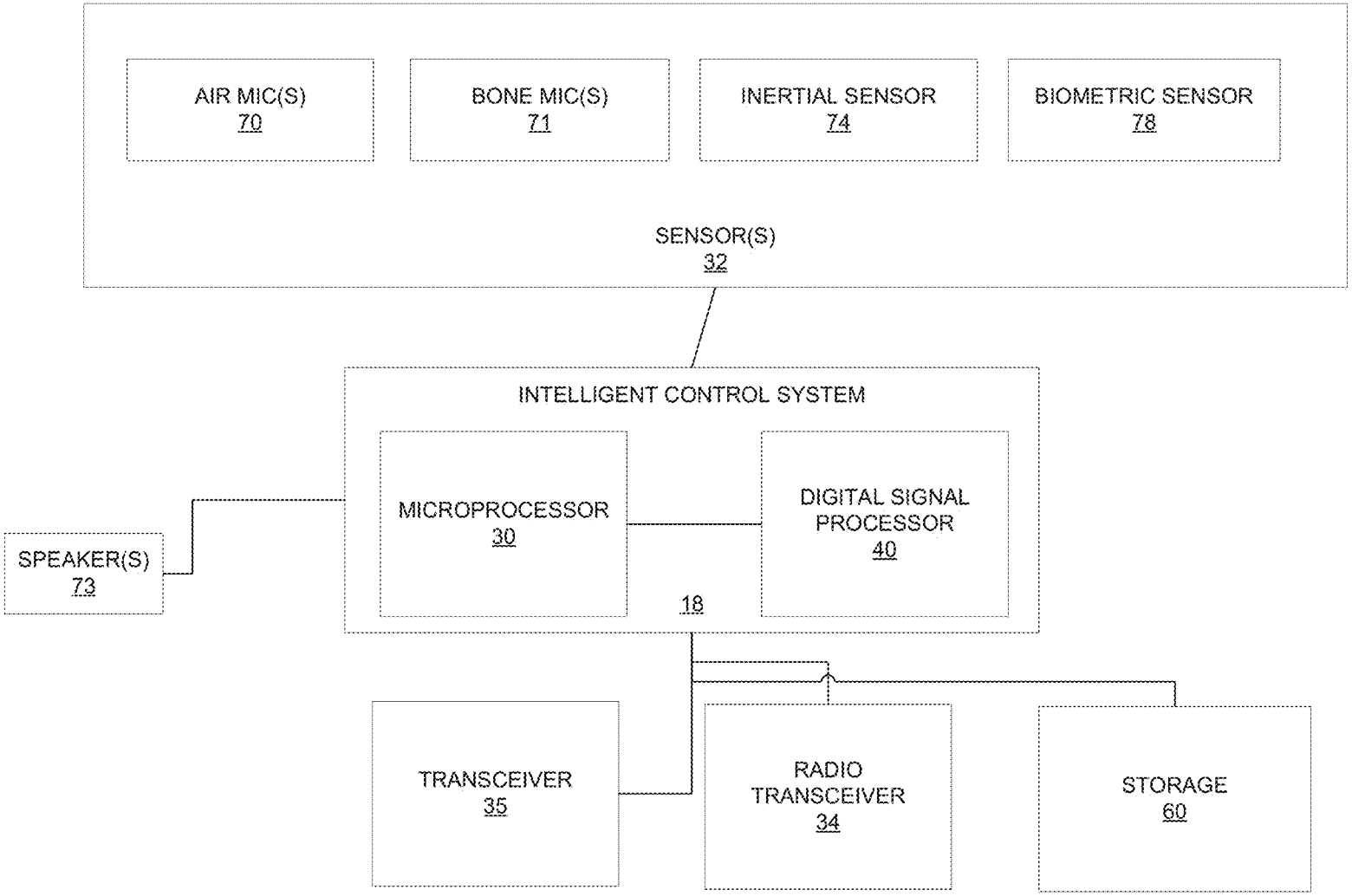
FIG. 2 is a block diagram of one example of an earpiece which may use a microphone for detecting physical or mechanical user interactions such as taps.

FIG. 2 illustrates one example of a block diagram for a wireless earpiece. As shown in FIG. 2, one or more sensors 32 are present. The sensors 32 may include one or more air microphones 70, one or more bone microphones 71, one or more inertial sensors 74, and one or more biometric sensors 78. The sensors 32 are operatively connected to an intelligent control system 18 which may include one or more processors such as a microprocessor microcontroller 30 and a digital signal processor 40. It is to be understood that inputs shown to the intelligent control system 18 may be in the form of electrical connections to one or both of the microprocessor 30 and the digital signal processor 40. Similarly, outputs shown from the intelligent control system 18 may be in the form of electrical connections from one or both of the microprocessor 30 and the digital signal processor 40.

In one configuration where a digital signal processor 40 is used, the digital signal processor 40 may process an audio signal to analyze an acoustical event. The digital signal processor may be configured to detect, classify, and identify acoustical events as user input in the form of user interactions such as taps. In one implementation, training may be permitted where a user is instructed to perform different actions including performing different physical events such as taps to collect examples of acoustical events. It is to be understood that varying levels of complexity to the processing may be applied if greater discernment in a user's actions are required. For example, if instead of tapping on a surface of the earpiece, tapping in other areas of the ear or head or on other items such as jewelry may require more complexity or computing power to detect, classify, and identify the acoustical event.

One or more speakers 73 are operatively connected to the intelligent control system. In addition, one or more transceivers may be in operative communication with the intelligent control system 18. For example, the transceiver 35 may be a near field magnetic induction (NFMI) transceiver which may, for example, be used to communicate between the earpiece and a second earpiece or other wearable device. The radio transceiver 34 is operatively connected to the intelligent control system 18. The radio transceiver 34 may be a Bluetooth transceiver, a BLE transceiver, a cellular transceiver, a UWB transceiver, a Wi-Fi transceiver, or other type of radio transceiver. Storage 60 is shown which is operatively connected to the intelligent control system 18. The storage 60 may be in the form of flash memory or other memory which may be used for various purposes including storing audio files which may be stored by the device and played back. Thus, for example, music may be played by the device or audio may be recorded by the device and stored locally. Of course, the storage 60 may be used to store other information as well.

As shown in FIG. 2, the earpiece includes a processor such as a digital signal processor 40. The digital signal processor 40 and other components may be disposed within the ear piece housing. There is at least one microphone 70 operatively connected to the digital signal processor 40. The earpiece is configured to receive audio from the microphone(s) 70 and process the audio with the digital signal processor 40 to determine if the user has performed a tap on the earpiece or performed another example of a physical operation or mechanical operation. The earpiece may further include a wireless transceiver (34 and/or 35) disposed within the ear piece wherein the earpiece is configured to communicate data indicative of occurrence of the tap using the wireless transceiver (34 and/or 35). In one embodiment transceiver 35 may be a near field magnetic induction transceiver (NFMI) and a radio transceiver 34 such as a Bluetooth, BLE, or other type of radio transceiver may be present. It is to be understood that where two earpieces are used together as a part of a system each earpiece need not have identical circuitry. For example, the earpieces may have different combinations of sensors. In one embodiment, only one of the earpieces need include a radio transceiver 34 as the other earpiece may communicate with it using a transceiver 35. The intelligent control system 18 which may be a processor, a combination of processors, FPGAs, microcontrollers, and/or digital signal processors may be configured to receive data indicative of the tap on the ear piece and may also be configured to receive data indicative of a tap on a different earpiece through the wireless transceiver. The intelligent control system 18 may be further programmed to interpret one or more taps on the earpiece and/or one or more taps on the different earpiece as a user command and to perform an action based on the user command. The action may include communicating the user command to another device such as a phone, tablet, or another wearable device in operative communication with the earpiece.

Figure 3:
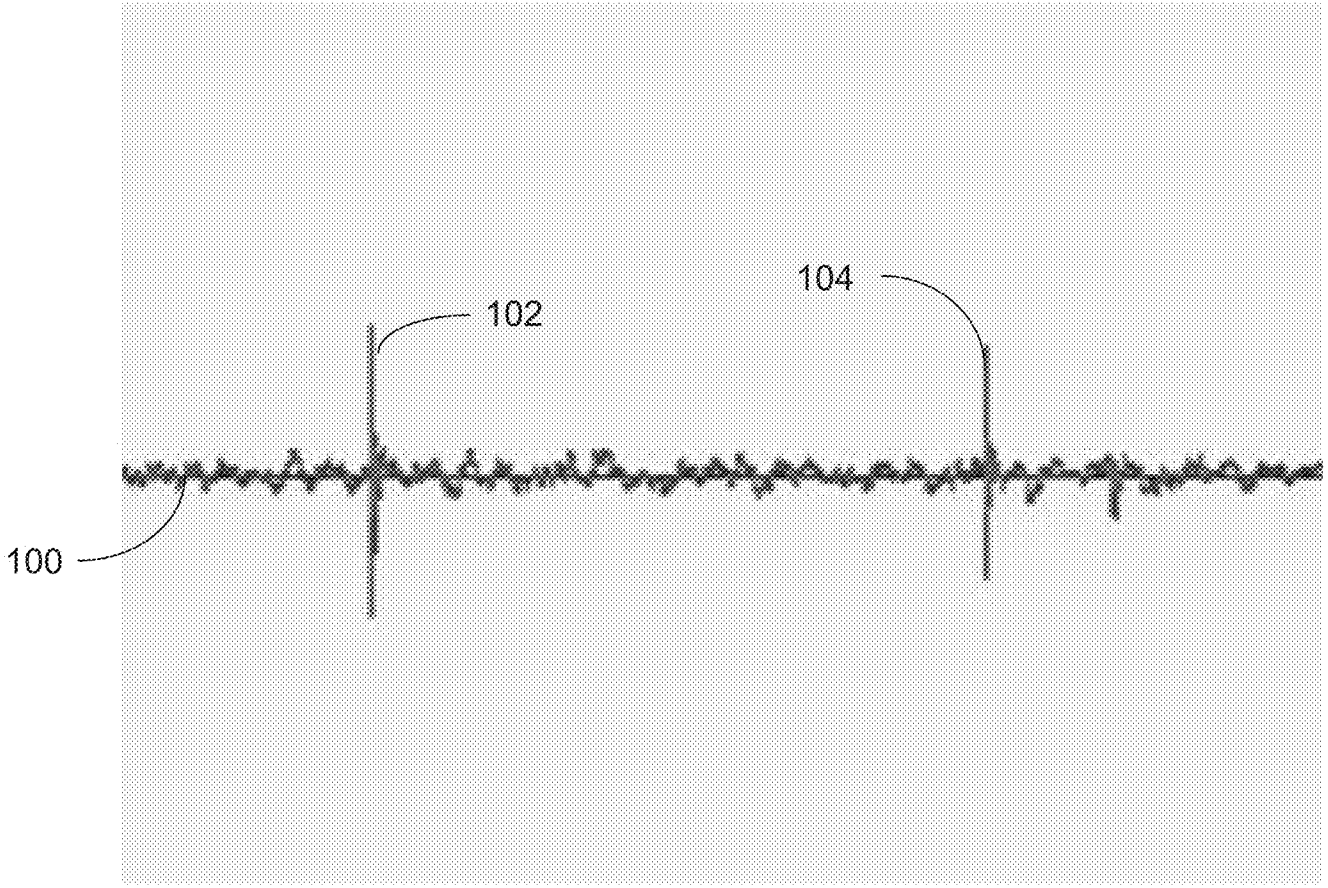
FIG. 3 illustrates an audio signal containing two tap events.

FIG. 3 illustrates an audio signal 100 from a microphone. A first waveform 102 is associated with a first tap on a wireless earpiece. A second waveform 104 is associated with a second tap on the wireless earpiece. Any number of audio processing algorithms may be used to detect the presence of one or more taps including audio event classification and detection algorithms. It is to be further understood that to assist with the determination of whether a tap has occurred, additional data may be combined with the analysis of the audio signal to reduce the likelihood of a false positive.

For example, a determination may be made as to whether contextual data is indicative that a user is likely or more likely to communicate with a tap. For example, if the wireless earpiece has just prompted the user with a voice prompt, it may be more likely that a user will communicate with one or more taps. Similarly, if the user has just inserted the wireless earpiece into the ear, it may be more likely that the user will communicate with one or more taps. The determination as to whether a user has just inserted the earpiece may be made based on inertial data, contact sensors, optical sensors, or otherwise.

By way of further example, inertial sensor data may be further used to assist in verifying that a user has performed a tap on the wireless earpiece. For example, an inertial signal may be correlated with the audio signal at the time of the tap to confirm the occurrence of a tap.

It is further to be understood that multiple microphone signals may be used in determining whether a tap has occurred or not, including multiple microphones present at the wireless earpiece. The use of multiple microphones and their respective positions relative to a surface for tapping, may be further be used to increase the likelihood of determining that a tap has occurred while reducing the likelihood of false positive events.

Therefore, an earpiece, system of earpieces, and associated methods have been shown and described. Although specific embodiments and examples have been shown and described, the present invention is not to be limited to any specific embodiments. In particular, options, variations, and alternatives are contemplated including in the specific structure, components, interactions between the components, number of microphones, types of microphones, type of processor(s) including digital signal processors, microprocessors, and or other types of processors, the shape or configuration of the earpiece housing, algorithms for performing analysis, whether the earpieces are integrated into a headset, the type of physical interaction with the earpieces, and other options, variations, and alternatives.

What is claimed is:

1. An earpiece comprising:

an earpiece housing;

a digital signal processor disposed within the earpiece housing;

at least one microphone operatively connected to the digital signal processor; and a processor disposed within the earpiece housing and a wireless transceiver disposed within the earpiece housing and operatively connected to the processor and wherein the processor is configured to receive data indicative of a tap on the earpiece from the digital signal processor and wherein the processor is configured to receive data indicative of a tap on a different earpiece through the wireless transceiver; wherein the earpiece is configured to receive audio from the at least one microphone and process the audio with the digital signal processor to determine if a user has performed the tap on the earpiece.

2. The earpiece of claim 1 further comprising a wireless transceiver disposed within the earpiece wherein the earpiece is configured to communicate data indicative of occurrence of the tap using the wireless transceiver.

3. The earpiece of claim 2 wherein the wireless transceiver is a near field magnetic induction transceiver.

4. The earpiece of claim 2 wherein the wireless transceiver is a radio transceiver.

5. The earpiece of claim 1 wherein the processor is further programmed to interpret one or more taps on the earpiece and/or one or more taps on the different earpiece as a user command and to perform an action based on the user command.

6. The earpiece of claim 5 wherein the action comprises communicating the user command to another device in operative communication with the earpiece.

7. The earpiece of claim 1 wherein the earpiece is configured to receive audio from the at least one microphone and process the audio with the digital signal processor to determine location of the tap on the earpiece.

8. The earpiece of claim 1 wherein the at least one microphone is positioned to face outwards.

9. The earpiece of claim 1 further comprising a surface for tapping on an outer portion of the earpiece housing.

10. The earpiece of claim 9 wherein at least one of the microphones is positioned at the surface.

11. An earpiece comprising:

an earpiece housing;

a processor disposed within the earpiece housing;

a wireless transceiver disposed within the earpiece housing and operatively connected to the processor and wherein the processor is configured to receive data indicative of a tap on the earpiece from a digital signal processor and wherein the processor is configured to receive data indicative of a tap on a different earpiece through the wireless transceiver;

at least one microphone operatively connected to the processor; and a wireless transceiver disposed within the earpiece housing and operatively connected to the processor;

wherein the earpiece is configured to receive audio from the at least one microphone and process the audio with the digital signal processor to determine if a user has performed the tap on the earpiece; wherein the earpiece is configured to interpret user input comprising the tap and perform an action based on the user input.

12. The earpiece of claim 11 wherein the user input further comprises one or more taps on an additional earpiece in operative communication with the earpiece.

13. The earpiece of claim 12 wherein the user input further comprises a plurality of taps including the tap.

14. The earpiece of claim 11 wherein the wireless transceiver is a radio transceiver.

15. The earpiece of claim 11 further comprising an inertial sensor operatively connected to the processor and wherein the processor is configured to correlate the audio with inertial sensor data from the inertial sensor in determining if the user has performed the tap on the earpiece.

* * * * *